US009617850B2

(12) United States Patent
Fripp et al.

(10) Patent No.: US 9,617,850 B2
(45) Date of Patent: Apr. 11, 2017

(54) HIGH-SPEED, WIRELESS DATA COMMUNICATION THROUGH A COLUMN OF WELLBORE FLUID

(71) Applicant: Halliburton Energy Services, Inc., Houston, TX (US)

(72) Inventors: Michael L. Fripp, Carrollton, TX (US); Kevin D. Fink, Carrollton, TX (US); Donald G. Kyle, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/907,211

(22) PCT Filed: Aug. 7, 2013

(86) PCT No.: PCT/US2013/054015

§ 371 (c)(1),
(2) Date: Jan. 22, 2016

(87) PCT Pub. No.: WO2015/020647

PCT Pub. Date: Feb. 12, 2015

(65) Prior Publication Data

US 2016/0168984 A1 Jun. 16, 2016

(51) Int. Cl.
*E21B 47/18* (2012.01)
*E21B 47/00* (2012.01)
(Continued)

(52) U.S. Cl.
CPC ..... *E21B 47/18* (2013.01); *E21B 47/00* (2013.01); *E21B 49/00* (2013.01); *E21B 49/08* (2013.01)

(58) Field of Classification Search
CPC ..... E21B 47/18; E21B 49/00; E21B 47/00; E21B 49/08
See application file for complete search history.

(56) References Cited

U.S. PATENT DOCUMENTS 4,571,693 A 2/1986 Birchak et al.
5,691,712 A 11/1997 Meek et al.
(Continued)

FOREIGN PATENT DOCUMENTS

EP 2597491 A1 5/2013

OTHER PUBLICATIONS

Pantea, Cristian. "Multipurpose Acoustic Sensor for Downhole Fluid Monitoring."; U.S. Department of Energy, Energy Efficiency & Renewable Energy; Los Alamos National Laboratory; May 19, 2010.

(Continued)

*Primary Examiner* — Erin File
(74) *Attorney, Agent, or Firm* — McGuireWoods LLP

(57) ABSTRACT

A communication system comprises: (A) a first transmitter that is acoustically coupled to a column of fluid located within a wellbore of an oil, gas, or water well, wherein the first transmitter transmits sound waves wirelessly through the column of fluid located within the wellbore, and wherein the sound waves are encoded with data; and (B) a first receiver that is acoustically coupled to the column of fluid located within the wellbore, wherein the first receiver receives the data-encoded sound waves, wherein the data-encoded sound waves communicate information about the well or a component of the wellbore. A method of communicating information wirelessly in a wellbore of an oil, gas, or water well comprises: providing the communication system; and causing or allowing the first transmitter to communicate information about the well or a component of the wellbore to the first receiver via the data-encoded sound waves.

25 Claims, 4 Drawing Sheets

(51) Int. Cl.
*E21B 49/00* (2006.01)
*E21B 49/08* (2006.01)

(56) References Cited

U.S. PATENT DOCUMENTS

| | | | | |
|---|---|---|---|---|
| 6,021,095 | A | 2/2000 | Tubel et al. | |
| 6,177,882 | B1 | 1/2001 | Ringgenberg et al. | |
| 6,401,538 | B1 | 6/2002 | Han et al. | |
| 6,817,229 | B2 | 11/2004 | Han et al. | |
| 6,957,700 | B2 | 10/2005 | Mandal | |
| 7,523,640 | B2 | 4/2009 | DiFoggio et al. | |
| 7,921,691 | B2 | 4/2011 | DiFoggio et al. | |
| 8,024,125 | B2 | 9/2011 | Hsu et al. | |
| 8,032,311 | B2 | 10/2011 | DiFoggio | |
| 8,037,747 | B2 | 10/2011 | DiFoggio | |
| 8,056,408 | B2 | 11/2011 | Pop et al. | |
| 8,258,975 | B2 | 9/2012 | Tinnen et al. | |
| 2008/0067116 | A1* | 3/2008 | Anderson | E21B 47/042 210/100 |
| 2010/0177596 | A1* | 7/2010 | Fink | E21B 47/14 367/81 |
| 2011/0069583 | A1* | 3/2011 | Camwell | E21B 47/091 367/82 |
| 2011/0164468 | A1 | 7/2011 | Robbins et al. | |
| 2012/0013893 | A1 | 1/2012 | Maida et al. | |
| 2015/0275657 | A1* | 10/2015 | Deffenbaugh | E21B 47/14 340/854.4 |
| 2016/0230545 | A1* | 8/2016 | McMillon | E21B 47/091 |

OTHER PUBLICATIONS

International Search Report and Written Opinion date mailed May 23, 2014; PCT International Application No. PCT/US2013/054015.

Salvatti, Alex, Allan Devantier, and Douglas J. Button. "Maximizing performance from loudspeaker ports." Journal of the Audio Engineering Society 50.1/2 (2002): 19-45.

Shane, Lemay E. "Attenuation of Acoustic Logging Signals." The Log Analyst, vol. XI, No. 6 Nov./Dec. 1970.

* cited by examiner

HIGH-SPEED, WIRELESS DATA COMMUNICATION THROUGH A COLUMN OF WELLBORE FLUID

TECHNICAL FIELD

A communication system can be used to send information within a wellbore of an oil, gas, or water well system. The communication system can include a transmitter and receiver. The information can be related to downhole tools, components, or sensors. The information can be sent via data-encoded sound waves. The sound waves can be sent through a column of fluid located within the wellbore. The information can be sent one-way, for example from a bottomhole portion of the well to the surface, or two-way-from bottom up and top down.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
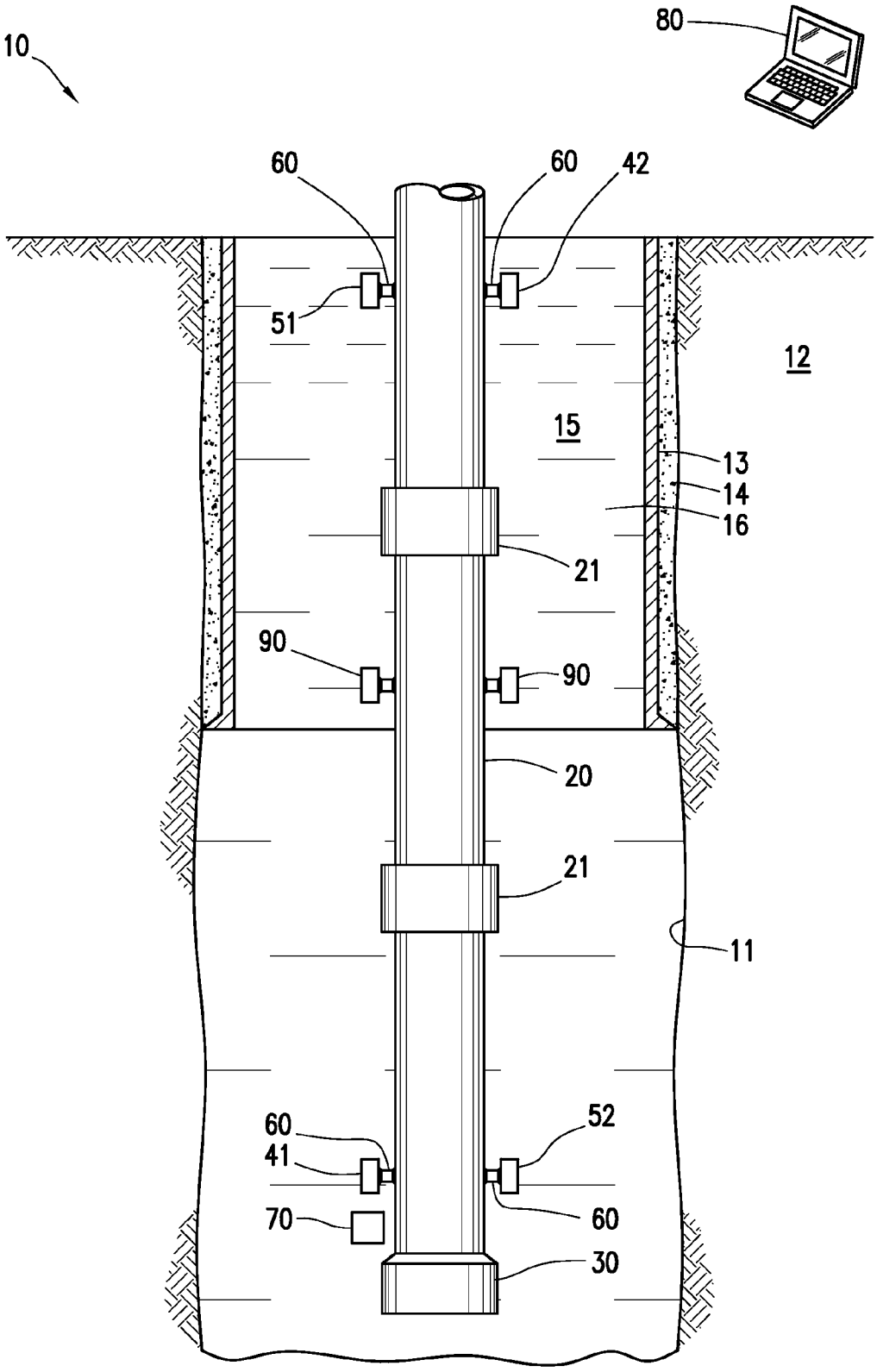
FIG. 1 is a schematic diagram showing a well system including an information communication system.

As used herein, the words "comprise," "have," "include," and all grammatical variations thereof are each intended to have an open, non-limiting meaning that does not exclude additional elements or steps.

It should be understood that, as used herein, "first," "second," "third," etc., are arbitrarily assigned and are merely intended to differentiate between two or more transmitters, receivers, etc., as the case may be, and does not indicate any particular orientation or sequence. Furthermore, it is to be understood that the mere use of the term "first" does not require that there be any "second," and the mere use of the term "second" does not require that there be any "third," etc.

As used herein, a "fluid" is a substance that can flow and conform to the outline of its container when the substance is tested at a temperature of 71° F. (22° C.) and a pressure of one atmosphere "atm" (0.1 megapascals "MPa"). A fluid can be a liquid or gas. A fluid can have only one phase or more than one distinct phase. A solution is an example of a fluid having only one distinct phase. A colloid is an example of a fluid having more than one distinct phase. A colloid can be: a slurry, which includes a continuous liquid phase and undissolved solid particles as the dispersed phase; an emulsion, which includes a continuous liquid phase and at least one dispersed phase of immiscible liquid droplets; a foam, which includes a continuous liquid phase and a gas as the dispersed phase; or a mist, which includes a continuous gas phase and liquid droplets as the dispersed phase. Any of the phases of a colloid can contain dissolved materials and/or undissolved solids.

Oil and gas hydrocarbons are naturally occurring in some subterranean formations. In the oil and gas industry, a subterranean formation containing oil, gas, or water is referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir. The oil, gas, or water produced from the wellbore is called a reservoir fluid.

A well can include, without limitation, an oil, gas, or water production well, an injection well, or a geothermal well. As used herein, a "well" includes at least one wellbore. The wellbore is drilled into a subterranean formation. The subterranean formation can be a part of a reservoir or adjacent to a reservoir. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, "into a well" means and includes into any portion of the well, including into the wellbore or into the near-wellbore region via the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore, which can also contain a tubing string. A wellbore can contain one or more annuli. Examples of an annulus include, but are not limited to: the space between the wall of the wellbore and the outside of a tubing string in an open-hole wellbore; the space between the wall of the wellbore and the outside of a casing in a cased-hole wellbore; and the space between the inside of a first tubing string and the outside of a second tubing string, such as a casing.

It is often useful to use acoustics during various oil or gas operations (e.g., drilling, logging, or completion) for a variety of applications. Acoustics deals with mechanical waves in a solid, liquid, or gas via vibration, sound, infrasound, or ultrasound. One example of such an application is to send information or a command that communicates with or activates downhole tools or components. As used herein, the term "downhole" means at a location beneath the Earth's surface and/or beneath the surface of a body of water for off-shore drilling and the term "subterranean" means at a location beneath the Earth's surface. Some of the downhole tools or components include, but are not limited to, packers, valves, sliding sleeves, fluid samplers, and downhole sensors. Digital information can be encoded in a series of acoustic waves. This information can be used to determine if a packer has set, to activate a valve, to move a sliding sleeve, to communicate a downhole sensor reading, etc. Acoustic waves through a fluid in a wellbore have been previously used in oilfield logging applications in order to evaluate the formation and to evaluate the fluid properties. However, these acoustic logging applications do not encode digital information into the series of acoustic waves.

Another example of using acoustics to send information about a wellbore component is relaying information from a downhole sensor. The downhole sensor can measure characteristics of wellbore fluids and/or characteristics of the bottomhole of the subterranean formation and/or characteristics of the downhole tool. The characteristics of wellbore fluids can include without limitation, composition, relative composition, temperature, viscosity, density, and flow rate. The characteristics of the subterranean formation can include without limitation, temperature, pressure, and permeability. The characteristics of the downhole tool can include without limitation, temperature, voltage, operational health, and battery life. Some of the previous techniques to use acoustics in these applications involve determining the speed of sound, attenuation of the signal, and/or acoustic back-scattering. These measurements are then used to extrapolate or calculate the desired characteristic.

In acoustics, sound waves are generated or propagate from a transmitter to a receiver. A device that functions as both a transmitter and a receiver is called a transceiver. The sound waves have a particular frequency, amplitude, and phase. The frequency is the number of waves that occur in a specific unit of time and can be reported in units of hertz (Hz). A frequency of 10 Hz means that 10 waves occur in 1 second(s). The amplitude is the difference between the crest and trough of the wave, or stated another way it is the height of the sound wave. The phase is the relative location of two sound waves that cross the same location at the same time. Data can be digitally encoded within sound waves. The data is encoded by an encoder. The encoder converts information from a processor, for example a sensor measurement (e.g., temperature) into a digital, electrical signal (e.g., data, a series of 1s and 0s that correspond to that temperature). The digital, electrical signal is then sent to a digital to analog "D/A" converter, which then converts the digital, electrical signal into an analog, electrical signal. The analog, electrical signal is sent to a transmitter, which converts the analog, electrical signal into a time-varying acoustic wave and transmits the data-encoded acoustic wave. The digital data is encoded in the time-varying acoustic wave by a change in: the frequency of the sound waves; the amplitude of the sound waves; the phase of the sound waves; or a combination of any of the three. This is known as modulation and can be frequency modulation, amplitude modulation, or phase modulation, respectively. For example, for frequency shift keying, a "0" could correspond to a specific frequency and a "1" could correspond to a different frequency. A receiver then receives the data-encoded acoustic waves and converts the acoustic waves into an analog, electrical signal. An analog to digital "A/D" converter then converts the analog, electrical signal into a digital, electrical signal, which is then sent to a decoder that converts the digital, electrical signal back in to information (e.g., the temperature). Another processor, for example a computer, can then be used to store and/or display the information and/perform a command. Information can also be relayed to downhole tools or components to communicate with or activate the tool or component.

As discussed earlier, prior techniques either do not actually encode data in the sound waves when the sound waves are traveling through a liquid. When the data is digitally encoded, these prior techniques involve sending the sound waves up through solid structure, most typically through a jointed tubing string located in the wellbore. The jointed tubing string is made up of multiple sections of pipe connected to each other via threaded connections. The cross-sectional area of the metal at the threaded connection is greater than the cross-sectional area of the metal at other sections of the tubing. The acoustic impedance of the tubing string is related to the cross-sectional area of the solid structure, to the density of the solid structure, and to the modulus of the solid structure. Therefore, as the sound waves travel up or down the tubing string, the connections cause a change in the acoustic impedance at the location of the connections. Changes in the acoustic impedance cause a partial reflection of the acoustic wave. Thus, some of the energy of the sound waves is lost as the acoustic waves encounter each change in acoustic impedance in the solid tubing. This loss in acoustic energy manifests as acoustic attenuation. There is additional acoustic attenuation in the damping of the solid structure. If the waves are reflected back towards the origin, then depending on the phase of each wave traveling in the opposite directions at the same time, the sound wave either can be passed with minimal attenuation or can become severely attenuated. Moreover, because of the large number of impedance mismatches at multiple locations along the tubing string, the amount of attenuation for a given frequency can be quite significant. This often time results in a substantial loss of amplitude at certain frequencies. However, since the phase of the reflected sound wave is directly related to the frequency of the sound waves, certain ranges of frequencies can result in a lower loss compared to other ranges of frequencies. The range of frequencies for a given medium (e.g., a tubing string) that can pass through the medium with minimal attenuation is called the passband. Commonly, the passband for tubing strings is a lower frequency range. Therefore, when acoustical data transfer occurs via an acoustic wave traveling through a tubing string, the amount of data being transmitted in a given timeframe, the baud rate, is fundamentally limited by the frequency of the acoustic wave. A higher frequency acoustic wave would have the potential for a higher baud rate.

There exists a need to send information via sound waves wirelessly. There is also a need to send the information at high-speed (i.e., a higher baud rate). There is also a need to reduce the amount of acoustic attenuation while having a wider range of frequencies that can be used to relay the information. The information can be useful for communicating with or activating downhole tools or components as well as obtaining useful information regarding wellbore fluids and/or subterranean formation conditions and/or downhole tools.

It has been discovered that high-speed wireless information transmission can be achieved by sending digitally-encoded sound waves through a column of wellbore fluids. By sending the sound waves through fluids instead of through a tubing string, there are fewer impedance mismatches, less overall attenuation, less loss of data, a broader pass band that can be utilized, and the potential for a faster rate of data communication. The communication of information can be a two-way system. That is, information can be acoustically transmitted from a bottomhole portion of a wellbore to the surface (called bottom-up transfer) and from the surface to a bottomhole portion of the wellbore (called top-down transfer). The bottom-up and top-down transfers may be for the entire wellbore or for sections within the wellbore. This can be useful when a worker at the surface receives information about a fluid, a wellbore characteristic, or downhole tool from a sensor and then that worker communicates, activates, or alters a downhole tool or component. In this manner, on-the-fly decisions can be made very quickly about a variety of oil or gas operations. The information communication can also be a one-way system, for example bottom-up transfer.

According to an embodiment, a communication system comprises: (A) a first transmitter that is acoustically coupled to a column of fluid located within a wellbore of an oil, gas, or water well, wherein the first transmitter transmits sound waves wirelessly through the column of fluid located within the wellbore, and wherein the sound waves are digitally encoded with data; and (B) a first receiver that is acoustically coupled to the column of fluid located within the wellbore, wherein the first receiver receives the data-encoded sound waves, wherein the data-encoded sound waves communicate information about the well or a component of the wellbore.

According to another embodiment, a method of communicating information wirelessly in a wellbore of an oil, gas, or water well comprises: providing the communication system; and causing or allowing the first transmitter to communicate information about the well or a component of the wellbore to the first receiver via the data-encoded sound waves.

According to yet another embodiment, a method of communicating information wirelessly two-ways in a wellbore of an oil, gas, or water well comprises: (A) providing a communication system, wherein the communication system comprises: (i) a first transmitter that is acoustically coupled to a first column of fluid located within the wellbore, wherein the first transmitter transmits sound waves wirelessly through the column of fluid located within the wellbore, and wherein the sound waves are digitally encoded with data; (ii) a first receiver that is acoustically coupled to the first column of fluid located within the wellbore, wherein the first receiver receives the data-encoded sound waves; (iii) a second transmitter that is acoustically coupled to the first or a second column of fluid located within the wellbore, wherein the second transmitter transmits sound waves wirelessly through the first or second columns of fluid located within the wellbore, and wherein the sound waves are digitally encoded with data; and (iv) a second receiver that is acoustically coupled to the first or a second column of fluid located within the wellbore; (B) causing or allowing the first transmitter to communicate information about the well or a component of the wellbore to the first receiver via the data-encoded sound waves; and (C) causing or allowing the second transmitter to communicate information to a component of the wellbore and the second receiver via data-encoded sound waves, wherein the two-way information communication occurs via the first transmitter and first receiver and the second transmitter and second receiver.

Any discussion of the embodiments regarding the communication system or any component related to the communication system (e.g., the first transmitter) is intended to apply to all of the apparatus and method embodiments. Any discussion of a particular component of an embodiment (e.g., a transmitter or a receiver) is meant to include the singular form of the component and the plural form of the component, without the need to continually refer to the component in both the singular and plural form throughout. For example, if a discussion involves "the transmitter," it is to be understood that the discussion pertains to a first or second transmitter (singular) and the first and second transmitters (plural).

Turning to the Figures, FIG. 1 is a schematic diagram of a well system 10. The well system 10 includes a wellbore 11. The wellbore 11 is part of an oil, gas, or water well. The well can be a production well or an injection well. The wellbore 11 penetrates a subterranean formation 12, wherein the subterranean formation can be an oil, gas, and/or water reservoir or adjacent to the reservoir. The wellbore 11 can include a cased portion and/or an open-hole portion. As shown in the Figures, the wellbore 11 can include a casing 13. The casing 13 can be cemented in place with cement 14. The well system 10 includes at least one tubing string 20. The wellbore 11 can contain one or more annuli 16. The annulus 16 can be located between any of the following: the outside of the tubing string 20 and the wall of the wellbore 11; the outside of the tubing string 20 and the inside of the casing 13; or the outside of the casing 13 and the wall of the wellbore 11; or the outside of a first tubing string and the inside of a second tubing string. Of course, there can be more than one annulus in various locations in the wellbore 11.

The well system 10 also includes a column of wellbore fluid 15. The column of wellbore fluid 15 can be located in the annulus 16 or in the inside of the tubing string 20. The wellbore fluid 15 can be any type of fluid that is used in oil, gas, or water well operations. For example, the wellbore fluid 15 can be a drilling fluid, completion fluid, work-over fluid, or enhanced recovery fluid. More specifically, the wellbore fluid 15 can be without limitation, a drilling mud, spacer fluid, brine, fracturing fluid, acidizing fluid, gravel pack fluid, or production fluids. There can also be more than one type of wellbore fluid 15 located in the wellbore 11 at a specific time. By way of example, a drilling mud can be located in the wellbore and then a spacer fluid can then be introduced into the wellbore such that both types of fluids are located within the wellbore. The methods can further include introducing the one or more wellbore fluids 15 into the wellbore 11, wherein the wellbore fluid is introduced prior to or after providing the communication system. According to an embodiment, the wellbore fluid 15 is located in the annulus 16. The information can be communicated via the transmitter 41/42 and receiver 51/52 when the column of wellbore fluid 15 is static (i.e., not flowing) or during fluid flow. When the fluid is static, the amount of noise in the well system 10 can be diminished. When the fluid is flowing, the fluid flow can help facilitate movement of the acoustic waves.

The well system 10 also includes a communication system. The communication system comprises a first transmitter 41 and a first receiver 51. The communication system can further include a second transmitter 42 and a second receiver 52. The transmitter 41/42 and receiver 51/52 are acoustically coupled to the column of wellbore fluid 15 located within the wellbore 11. The transmitter 41/42 and the receiver 51/52 can be acoustically coupled in a variety of manners to the column of wellbore fluid. By way of example, the transmitter 41/42 and receiver 51/52 can be operatively connected to the tubing string 20. Preferably, no part of the transmitter and receiver (e.g., a housing) is in direct contact with the tubing string 20, the casing 13, or the wall of the wellbore 11, but rather is mostly or completely surrounded by the column of wellbore fluid 15. According to an embodiment, the transmitter 41/42 and receiver 51/52 are connected to the tubing string via a support 60. The support 60 can be designed to attach to and protrude away from the outside of the tubing string 20 such that the housing of the transmitter 41/42 and receiver 51/52 is not in direct contact with the tubing string 20. In this manner, sound waves will propagate out from the transmitter 41/42 and travel through the column of wellbore fluid 15 instead of through the tubing string 20.

The transmitter 41/42 transmits sound waves wirelessly through the column of fluid locate within the wellbore (the column of wellbore fluid 15). The sound waves are digitally encoded with data. To digitally encode the sound waves, the communication system can further comprise a first and second processor. The first processor can be part of a sensor or a stand-alone component. The second processor can be part of a computer or a stand-alone component. The communication system can also comprise a first and possibly a second encoder (not shown). The encoder can be part of a processor, sensor, or transmitter, or a stand-alone component. The processor can process information, for example, from a sensor. The encoder can receive information from the processor and convert the information into a digital, electrical signal (i.e., data). By way of example, if the information is the temperature at a sensor location, then the encoder can convert that temperature information into a specific series of digital, electrical data (i.e., "1"s and "0"s) which is the digital, electrical signal.

The communication system can further comprise a first digital to analog "D/A" converter (not shown). The D/A converter can be part of the transmitter or a stand-alone component. The D/A converter can also be a stand-alone component. The D/A converter can be capable of receiving the digital, electrical signal from the encoder and converting the digital, electrical signal into an analog, electrical signal. The transmitter 41/42 can then receive the analog, electrical signal and convert the signal into the sound waves that are digitally encoded with the data. The transmitter 41/42 then transmits the data-encoded sound waves through the column of the wellbore fluid 15. There are a variety of mechanisms by which the sound waves can be digitally encoded with the data. The digital data can be encoded in the time-varying acoustic wave by a change in: the frequency of the sound waves; the amplitude of the sound waves; the phase of the sound waves; or a combination of any of the three. Accordingly, the sound waves can be digitally encoded with the data via frequency modulation, amplitude modulation, phase modulation, or a combination of any of the three. For example, for frequency shift keying, a "0" could correspond to a specific frequency and a "1" could correspond to a different frequency. The above-mentioned encoding techniques can also include on-off modulation, as well as quadrature modulation, differential modulation, and continuous modulation. According to an embodiment, the range of frequencies (commonly called the passband) is much broader compared to transmission of the data-encoded sound waves that are transmitted through the tubing string 20. According to another embodiment, the data is transmitted at high speed or at a high baud rate. According to this embodiment, the range of frequencies selected can be a higher range of frequencies such that the desired speed or baud rate is achieved.

The receiver 51/52 then receives the data-encoded sound waves. The receiver 51/52 can then convert the data-encoded sound waves into an analog, electrical signal. The communication system can further comprise an analog to digital "A/D" converter (not shown). The A/D converter can be part of the receiver or a stand-alone component. The A/D converter can convert the analog, electrical signal into digital, electrical data. The digital, electrical data can then be sent to a decoder (not shown). The decoder can be part of a processor or receiver, or a stand-alone component. The decoder can decode the data back into information. The communication system can further comprise a second processor 80. The first and/or second processors can include, but are not limited to a DSP processor, an ARM processor, and a PIC processor. The processor 80 can display and/or store the information from the decoder. The processor can also perform a command.

The data-encoded sound waves communicate information about the well or a component of the wellbore 11. The methods include causing or allowing the first transmitter 41 to communicate information about the well or a component of the wellbore. The information can include without limitation, information from a downhole tool or component 30, information from a downhole sensor 70, or a command to a downhole tool or component or downhole sensor. According to an embodiment, at least a one-way information communication occurs. That is, at least information related to a downhole tool or component, or a downhole sensor is relayed from the first transmitter 41 to the first receiver 51 in a bottom-up transfer. Two-way communication will be discussed in more detail below. Some of the downhole tools or components 30 include, but are not limited to, packers, valves, sliding sleeves, and fluid samplers. By way of example, the information can be used to determine if a packer has set. The information can also be from the downhole sensor 70. The well system 10 can include more than one downhole sensor 70. The first receiver 51 can transmit the digitally encoded sound waves from any of the downhole sensors 70. The downhole sensor 70 can measure inter alia characteristics of wellbore fluids and/or characteristics of the bottomhole of the subterranean formation and/or characteristics of the downhole tool. The characteristics of wellbore fluids can include without limitation, fluid composition, relative composition, temperature, viscosity, density, and flow rate. The characteristics of the subterranean formation can include without limitation, temperature, pressure, and permeability. The characteristics of the downhole tool can include without limitation, temperature, voltage, operational health, and battery life. In this manner, a worker at the surface can accurately and quickly monitor a variety of information from the well and/or a wellbore component.

The downhole sensor 70 can be pre-programmed to relay the information to the transmitter (via, for example, the encoder and transducer) at a specific time interval (e.g., every 5 minutes). The downhole sensor 70 can also be operator-driven such that a worker at the surface activates the sensor to relay the information on command. The downhole sensor 70 can also be an autonomous sensor such that the information is relayed when a change in sensor readings occurs.

As discussed previously, when sound waves are sent through a tubing string 20 the amount of attenuation increases due to the changes in acoustic impedance at each connection 21 in the tubing string. As can be seen in the Figures, the cross-sectional area of the connection 21 is greater than the cross-sectional area of the sections of pipe making up the tubing string 20. The difference in the cross-sectional area of the connection 21 and the cross-sectional area of the sections of pipe making up the tubing string 20 can be significant. However, as can also be seen in the Figures, the difference in the cross-sectional area of the column of wellbore fluid 15 at each connection 21 and the sections of pipe is less than the difference in the cross-sectional areas of the connections and tubing string. Therefore, when the sound waves are sent through the column of wellbore fluid 15, there will be minimal changes in the acoustic impedance throughout the entire column of fluid.

The communication system can further include one or more repeaters 90. The repeater 90 can be located between the transmitter 41/42 and the receiver 51/52. The repeater 90 can be acoustically coupled to the column of wellbore fluid 15. According to an embodiment, the repeater 90 is acoustically coupled to the same column of wellbore fluid 15 as the transmitter 41/42 and receiver 51/52. The repeater 90 can be used to repeat the data-encoded sound waves to either the next repeater or the receiver 51/52. This aspect may be useful in a variety of situations including, but not limited to, the annular space, the distance between the transmitter and receiver, the strength of the transmitter, the encoding scheme, how much noise is in the system, the type of wellbore fluid, and if there are two or more types of wellbore fluids. For example, if the distance between the transmitter 41/42 and the receiver 51/52 is very large, then the repeater 90 can help ensure that a good transmission of the sound waves occurs. Another example is if there is more than one type of wellbore fluid 15. According to this example, a difference in acoustic impedance can occur at the interface of the two different fluids. Therefore, in order to help minimize the amount of attenuation at the fluids' interface, a first repeater 90 can be located in proximity to the bottom of the interface and a second repeater 90 can be located in proximity to the top of the interface (i.e., below and above the interface line). Of course, the repeater 90 can be positioned at any desirable location within the wellbore 11. The repeater 90 can be introduced into the wellbore 11 during the oil, gas, or water operation or the repeater can be attached to the tubing string during running of the tubing string. The repeater 90 can be attached to the tubing string 20 via the support 60.

The communication system can also be used for two-way information communication. As can be seen in FIG. 1, the communication system can also include the second transmitter 42 and the second receiver 52. According to this embodiment, the second transmitter 42 can be used to send information or a command that communicates with or activates the downhole tool or component 30 or the downhole sensor 70. The activation of the downhole tool or component 30 can include without limitation, activation of a valve, to move a sliding sleeve, to communicate a downhole sensor reading, etc. In this manner, the first transmitter 41 can transmit information from a downhole tool or component or downhole sensor to the surface. A worker at the surface can then analyze that information and send other information to a downhole tool or component or downhole sensor to activate or communicate with the tool or component or sensor. The following is one example of using two-way communication in the well system. A downhole sensor 70 can be coupled to a valve containing a sliding sleeve. The sensor can relay information about the location of the sliding sleeve to the surface via the first transmitter 41 and the first receiver 51. A worker can then use this information to send a command to the sliding sleeve to move the sleeve into the desired position via the second transmitter 42 and second receiver 52.

Figure 2A:
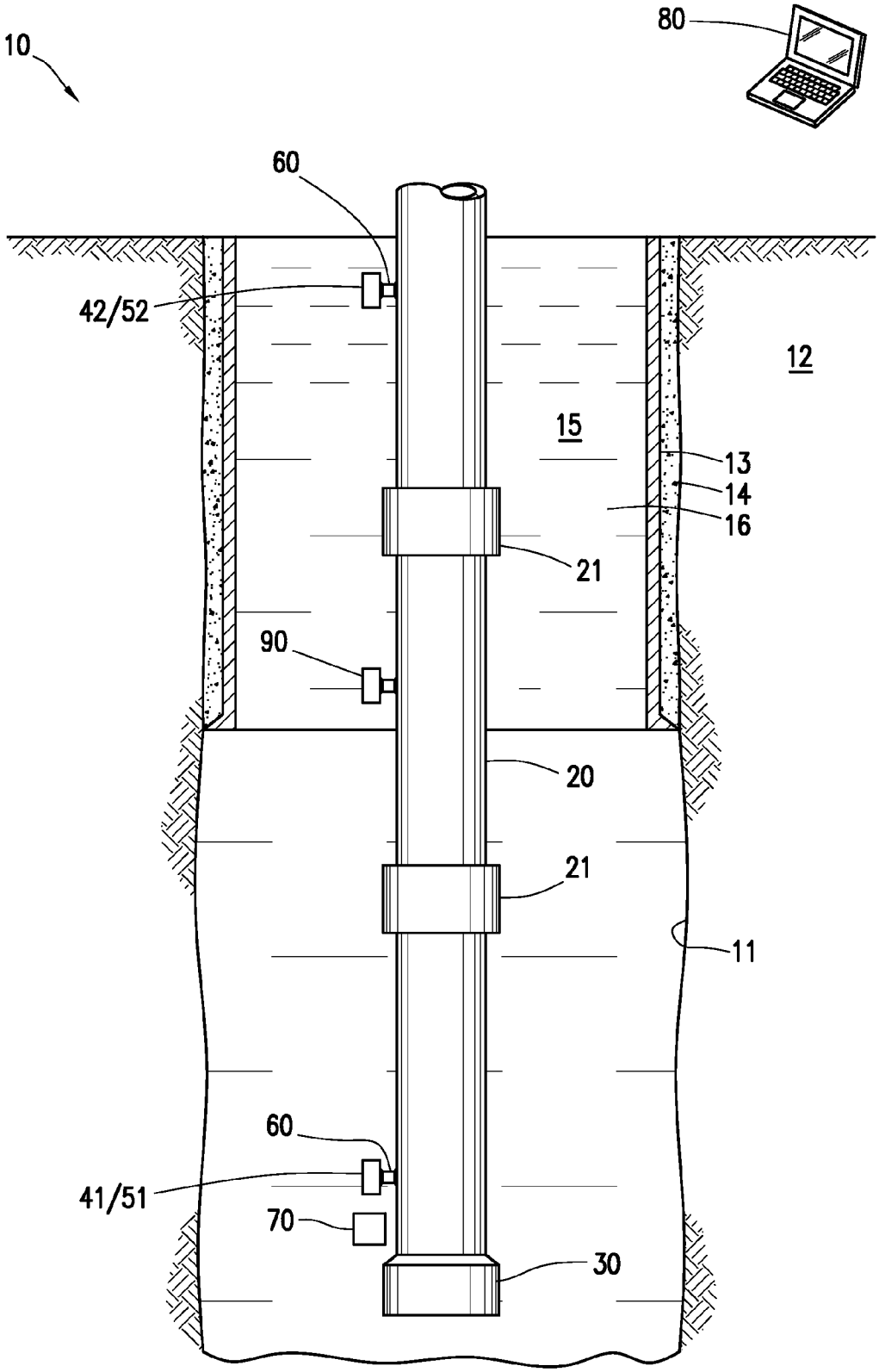
FIG. 2A is a schematic diagram showing a well system according to another embodiment where the information communication system includes two transceivers.

Turning to FIG. 2A, the transmitter 41/42 and the receiver 51/52 can each be a transceiver. For example, there can be a first transceiver 41/51 and a second transceiver 42/52. The first transceiver 41/51 can transmit the data-encoded sound waves to the second transceiver 42/52, wherein the second transceiver 42/52 receives the sound waves. Moreover, the second transceiver 42/52 can transmit the data-encoded sound waves to the first transceiver 41/51. In this manner, separate transmitters and receivers may not be required. The first transceiver 41/51 and second transceiver 42/52 can be used for one-way, bottom to top communication or two-way communication. It should be noted that for simultaneous two-way information communication, it may be necessary to employ separate transmitters and receivers such that the first transmitter and receiver can relay information at the same time that the second transmitter and receiver relays information. For simultaneous two-way communication, there may need to be two separate columns of wellbore fluid as depicted in FIG. 1. There can also be a combination of transmitters, receivers, and transceivers.

Figure 2B:
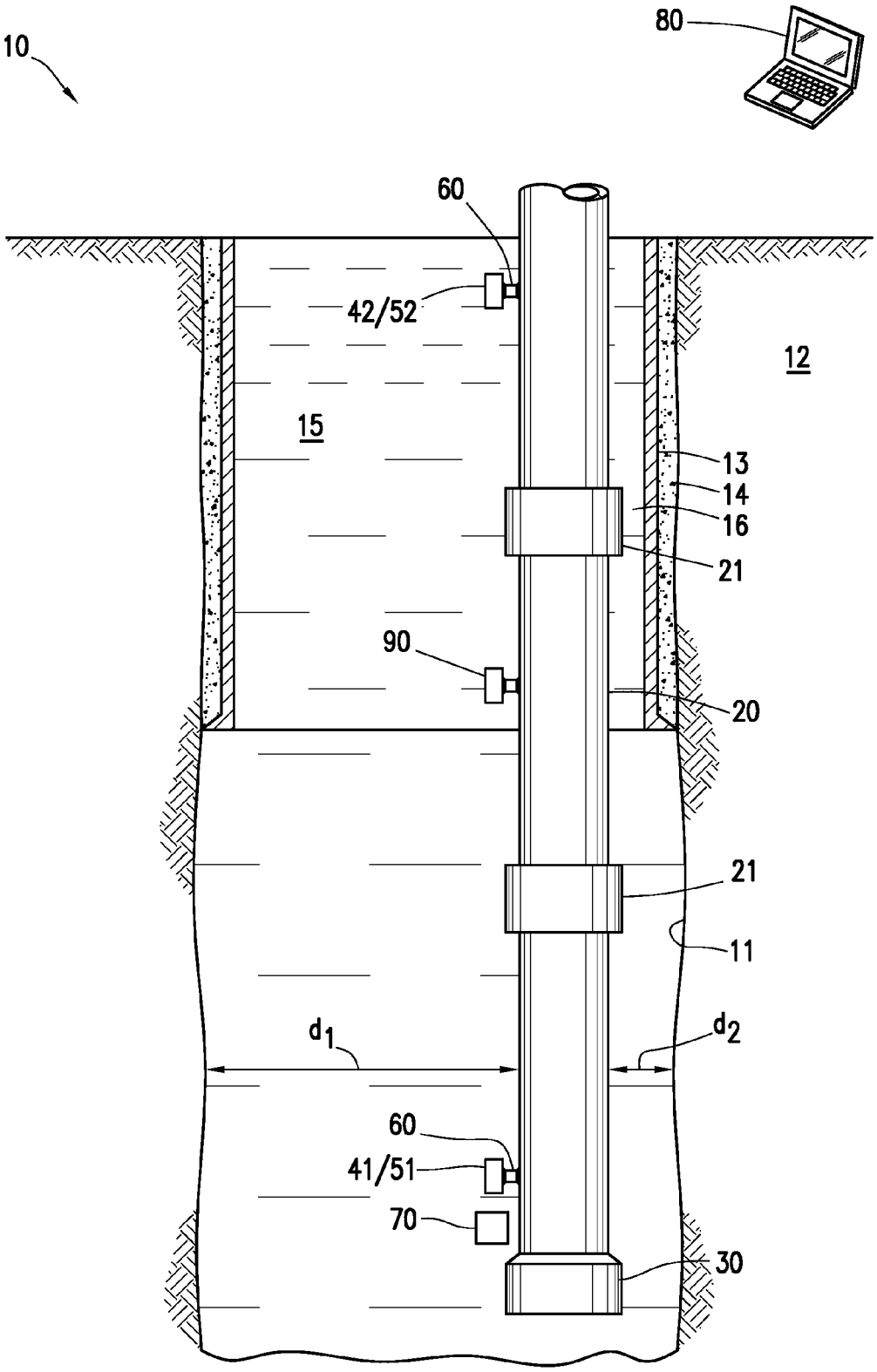
FIG. 2B is a schematic diagram of FIG. 2A showing a tubing string being decentralized in a wellbore of the well system.

FIG. 2B depicts the well system 10 according to an embodiment. As shown in FIG. 2B, the tubing string 20 can be decentralized. That is, the tubing string 20 can be positioned within the wellbore 11 such that a central, vertical axis of the tubing string is not centered within the diameter of the wellbore 11. According to this embodiment, a first distance $d_1$ from an outside of the tubing string 20 and the wall of the wellbore 11 is greater than a second distance $d_2$ from an opposite outside of the tubing string and an opposite wall of the wellbore. In this manner, the cross-sectional area of the column of wellbore fluid 15 related to the first distance $d_1$ will be greater than the cross-sectional area of the fluid related to the second distance $d_2$. Moreover, there will be a decreased change in the hydraulic radius between the outside of the tubing string and the wall of the wellbore at each connection 21 due to the tubing string being decentralized. This means that there will be less reflectance of the sound waves and a more consistent hydraulic radius in the column of fluid related to the first distance $d_1$. According to this embodiment, the transmitter 41/42, the receiver 51/52, and/or the first transceiver 41/51 and second transceiver 42/52 would be positioned adjacent to the tubing string 20 on the outside of the tubing string related to the first distance $d_1$. Accordingly, the transmitters, receivers, and/or transceivers would be located within the wellbore such that a greater volume of wellbore fluid 15 surrounds them. This embodiment may be useful to provide for easier coupling of the transmitters, receivers, and/or transceivers to the column of wellbore fluid or to help eliminate or diminish a difference in acoustic impedance. This can be accomplished due to the greater volume of fluid surrounding the transmitters etc. and the more consistent hydraulic radius.

Figure 3:
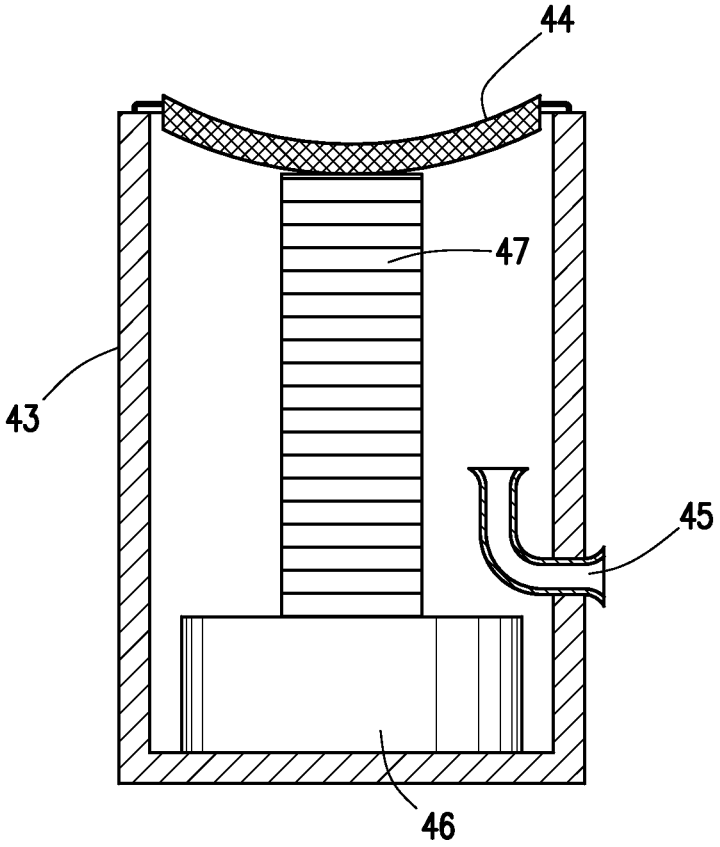
FIG. 3 is a plan view of a transmitter having a port and proof mass.

Turning to FIG. 3, the transmitter 41/42 can include a housing 43 and a speaker 44. Although depicted in the drawing as conical in shape, the speaker can have a variety of shapes including, but not limited to square, rectangular, cylindrical, a frustrum, dome, or other geometric shapes. The discussion of embodiments related to the transmitter 41/42 applies equally to a transceiver. The housing 43 can be an air-filled chamber or preferably a fluid filled chamber. The transmitter 41/42 can be a monopole transmitter or dipole transmitter. One example of a monopole transmitter is a cylinder operating in a hoop mode. One example of a dipole transmitter is a Bender bar. The transmitter 41/42 can include a piezoelectric material, for example a piezoceramic composite material. The transmitter can also include a lead magnesium niobate material, a ferroelectric material, a magnetostrictive material, or a voice coil. The transmitter can include an offset weight moving inside of the housing 43. The stiffness of the material can be adjusted to provide a better impedance match with the type of wellbore fluid 15. Some of the advantages to using these types of materials is to provide better fluid coupling and obtain a more efficient acoustic radiation and direction. The receiver 51/52 can also include the housing and these materials. These materials can function as a transmitter, a receiver, and the and the D/A converter or A/D converter. The material can be several separate pieces of material stacked together. The pieces of material can be concentric in shape. The pieces of material can include a top surface, a bottom surface, and a side. The side can be concentric. The top surfaces can be aligned in a variety of manners to provide optimum transmission of the data-encoded sound waves. For example, the top surfaces of the pieces of material can lie in a plane that is perpendicular to the receiver 51/52 (i.e., the top surfaces face the receiver) or the top surfaces can lie in a plane that is parallel to the receiver (i.e., the top surfaces face a wall of the wellbore or tubing string). Moreover, there can be more than one stack of pieces of material. The top surfaces of the pieces of material for each stack can lie in different planes with respect to the receiver.

The transmitter 41/42 can also include a port 45 or more than one port. The port can reduce the amount of back-pressure on the speaker cone 44. The port 45 can also be designed, configured, and tuned to enhance the frequency response of the transmitter 41/42. The transmitter 41/42 can also include a proof mass 46. The transmitter 41/42 can also include an actuator 47. The proof mass 46 is preferably located at an end of the housing 43 between the speaker 44 and the actuator 47. The proof mass 46 can direct the motion or expansion into the speaker rather than allowing the motion to be shared between the speaker and the housing. As can be seen in FIG. 3, actuator 47 will act on both the speaker and the housing. Without the proof mass 46, when excited, the actuator will equally move the housing and the speaker 44. However, with the proof mass 46, the housing will have larger inertia and, thus, more of the movement of the actuator 47 will be directed to the speaker 44. Depending on the arrangement of the speaker and/or the material or the stacks of pieces of material, the proof mass may be positioned at a desired location anywhere within the housing or on the outside of the housing such that an optimum directional movement or vibration of the speaker is achieved. In the preferred embodiment, the proof mass is mechanically coupled to the housing and the actuator lies between the housing and the speaker.

The methods can further include causing or allowing the second transmitter 42 to communicate information to a component of the wellbore and the second receiver 52 via data-encoded sound waves. The component of the wellbore can be a downhole tool or component 30 or a downhole sensor 70. The information can be a command or other information. The methods can also include the step of monitoring information about the well or a component of the wellbore via the computer 80. The computer can also be used to store information about the well or the component of the wellbore.

The communication system can include a first encoder, wherein the encoder receives the information and converts the information into digital, electrical data by a change in: the frequency of the electrical signal; the amplitude of the electrical signal; the phase of the electrical signal; or combinations thereof, and wherein the communication system further comprises a digital to analog converter, wherein the digital to analog converter receives the digital, electrical data from the encoder and converts the digital, electrical data into analog, electrical data.

One-way information communication can occur from a downhole portion of the wellbore to the surface of the wellbore, wherein the information is from a downhole tool or component or a downhole sensor, wherein the downhole tool or component is selected from the group consisting of a packer, a valve, a sliding sleeve, a fluid sampler, or combinations thereof, wherein the wellbore penetrates a subterranean formation, wherein the subterranean formation is an oil, gas, water, or combinations thereof, reservoir or adjacent to the reservoir, and wherein the downhole sensor measures characteristics of wellbore fluids and/or characteristics of the bottomhole of the subterranean formation and/or characteristics of the downhole tool or component.

The communication system can further comprise a second transmitter and a second receiver, wherein the second transmitter and second receiver are acoustically coupled to a column of fluid located within the wellbore, causing or allowing the second transmitter to communicate information to a component of the wellbore and the second receiver via data-encoded sound waves, wherein the information from the second transmitter communicates with or activates a downhole tool or component or a downhole sensor, and wherein two-way information communication occurs via the first transmitter and first receiver and the second transmitter and second receiver.

The first and/or the second transmitter can include a piezoelectric material, a lead magnesium niobate material, a ferroelectric material, a magnetostrictive material, a voice coil, or combinations thereof, and wherein the first and/or the second transmitter comprises one or more stacks of pieces of the material.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. It is to be understood that multiple claims and/or embodiments disclosed herein can be combined in a variety of ways. Such combinations can define further embodiments. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of communicating information wirelessly in a wellbore of an oil, gas, or water well comprising:

providing a communication system, wherein the communication system comprises:

a first transmitter that is acoustically coupled to a column of fluid located within the wellbore, wherein the first transmitter transmits sound waves wirelessly through the column of fluid located within the wellbore, and wherein the sound waves are encoded with data;

a first receiver that is acoustically coupled to the column of fluid located within the wellbore, wherein the first receiver receives the data-encoded sound waves;

a second transmitter acoustically coupled to the column of fluid located within the wellbore; and a second receiver acoustically coupled to the column of fluid located within the wellbore; and causing or allowing the first transmitter to communicate information about the well or a component of the wellbore to the first receiver via the data-encoded sound waves.

2. The method according to claim 1, wherein the wellbore includes a cased portion, an open-hole portion, or combinations thereof.

3. The method according to claim 1, wherein the column of fluid located within the wellbore is located in an annulus of the wellbore or in the inside of the tubing string.

4. The method according to claim 1, wherein more than one type of wellbore fluid is located within the wellbore at a specific time.

5. The method according to claim 1, wherein the communication system further comprises a first encoder, wherein the first encoder receives the information and converts the information into digital, electrical data by a change in: the frequency of the electrical signal; the amplitude of the electrical signal; the phase of the electrical signal; or combinations thereof.

6. The method according to claim 5, wherein the communication system further comprises a digital to analog converter, wherein the digital to analog converter receives the digital, electrical data from the encoder and converts the digital, electrical data into analog, electrical data.

7. The method according to claim 1, wherein one-way information communication occurs from a downhole portion of the wellbore to the surface of the wellbore.

8. The method according to claim 7, wherein the information is from a downhole tool or component or a downhole sensor.

9. The method according to claim 8, wherein the downhole tool or component is selected from the group consisting of a packer, a valve, a sliding sleeve, a fluid sampler, or combinations thereof.

10. The method according to claim 9, wherein the wellbore penetrates a subterranean formation, wherein the subterranean formation is an oil, gas, water, or combinations thereof reservoir or adjacent to the reservoir, and wherein the downhole sensor measures characteristics of wellbore fluids, characteristics of the bottomhole of the subterranean formation, characteristics of the downhole tool or component, or any combination thereof.

11. The method according to claim 6, wherein the first transmitter converts the analog, electrical data into the data-encoded sound waves.

12. The method according to claim 1, further comprising causing or allowing the second transmitter to communicate information to a component of the wellbore and the second receiver via data-encoded sound waves.

13. The method according to claim 1, wherein the information from the second transmitter communicates with or activates a downhole tool or component or a downhole sensor.

14. The method according to claim 13, wherein two-way information communication occurs via the first transmitter and first receiver and the second transmitter and second receiver.

15. The method according to claim 1, wherein the first transmitter and the first receiver is a first transceiver, and wherein the second transmitter and the second receiver is a second transceiver.

16. The method according to claim 12, wherein the data is transmitted at high speed or at a high baud rate.

17. The method according to claim 1, wherein the first and second transmitters comprise a housing and a speaker.

18. The method according to claim 1, wherein the first and second transmitters are a monopole transmitter or dipole transmitter.

19. The method according to claim 17, wherein the first and/or the second transmitters further comprise a port, an actuator, a proof mass, or any combination thereof.

20. The method according to claim 1, wherein the first and/or the second transmitter comprises a piezoelectric material, a lead magnesium niobate material, a ferroelectric material, a magnetostrictive material, a voice coil, or combinations thereof.

21. The method according to claim 20, wherein the first and/or the second transmitter comprises one or more stacks of pieces of the material.

22. The method according to claim 1, wherein the communication system further comprises one or more repeaters, wherein the repeater is located between the first transmitter and the first receiver and/or between the second transmitter and the second receiver, wherein the repeater is acoustically coupled to the column of fluid located within the wellbore, and wherein the repeater repeats the data-encoded sound waves to either a next repeater or the first and/or second receiver.

23. The method according to claim 1, wherein the tubing string is decentralized, wherein the tubing string is positioned within the wellbore such that a central, vertical axis of the tubing string is not centered within the diameter of the wellbore.

24. A communication system comprising:

a first transmitter that is acoustically coupled to a column of fluid located within a wellbore of an oil, gas, or water well, wherein the first transmitter transmits sound waves wirelessly through the column of fluid located within the wellbore, and wherein the sound waves are encoded with data;

a first receiver that is acoustically coupled to the column of fluid located within the wellbore, wherein the first receiver receives the data-encoded sound waves;

a second transmitter acoustically coupled to the column of fluid located within the wellbore; and a second receiver acoustically coupled to the column of fluid located within the wellbore;

wherein the data-encoded sound waves communicate information about the well or a component of the wellbore.

25. A method of communicating information wirelessly two-ways in a wellbore of an oil, gas, or water well comprising:

(A) providing a communication system, wherein the communication system comprises:

(i) a first transmitter that is acoustically coupled to a first column of fluid located within the wellbore, wherein the first transmitter transmits sound waves wirelessly through the first column of fluid located within the wellbore, and wherein the sound waves are encoded with data;

(ii) a first receiver that is acoustically coupled to the first column of fluid located within the wellbore, wherein the first receiver receives the data-encoded sound waves;

(iii) a second transmitter that is acoustically coupled to the first or a second column of fluid located within the wellbore, wherein the second transmitter transmits sound waves wirelessly through the first or second column of fluid located within the wellbore, and wherein the sound waves are encoded with data; and (iv) a second receiver that is acoustically coupled to the first or second column of fluid located within the wellbore;

(B) causing or allowing the first transmitter to communicate information about the well or a component of the wellbore to the first receiver via the data-encoded sound waves; and (C) causing or allowing the second transmitter to communicate information to a component of the wellbore and the second receiver via data-encoded sound waves, wherein the two-way information communication occurs via the first transmitter and first receiver and the second transmitter and second receiver.

* * * * *